US006695687B2

(12) United States Patent
Hollatz et al.

(10) Patent No.: US 6,695,687 B2
(45) Date of Patent: Feb. 24, 2004

(54) SEMICONDUCTOR SUBSTRATE HOLDER FOR CHEMICAL-MECHANICAL POLISHING CONTAINING A MOVABLE PLATE

(75) Inventors: Mark Hollatz, Neustadt/Sachsen (DE); Peter Lahnor, Dresden (DE)

(73) Assignee: Infineon Technologies AG, Munich (DE)

( * ) Notice: Subject to any disclaimer, the term of this patent is extended or adjusted under 35 U.S.C. 154(b) by 61 days.

(21) Appl. No.: 10/156,482

(22) Filed: May 28, 2002

(65) Prior Publication Data

US 2002/0177394 A1 Nov. 28, 2002

(30) Foreign Application Priority Data

May 25, 2001 (EP) ..... 01112711

(51) Int. Cl.[7] ..... B24B 7/22
(52) U.S. Cl. ..... 451/288; 451/388; 451/289
(58) Field of Search ..... 451/289, 288, 451/287, 388, 398, 41

(56) References Cited

U.S. PATENT DOCUMENTS 5,423,716 A * 6/1995 Strasbaugh ..... 451/388
5,441,444 A 8/1995 Nakajima
5,449,316 A * 9/1995 Strasbaugh ..... 451/289
5,762,539 A * 6/1998 Nakashita et al. ..... 451/41
5,791,973 A 8/1998 Nishio
5,795,215 A * 8/1998 Guthrie et al. ..... 451/286
6,012,964 A 1/2000 Arai et al.
6,024,630 A * 2/2000 Shendon et al. ..... 451/41
6,074,289 A 6/2000 Murakami et al.
6,083,090 A * 7/2000 Bamba ..... 451/288

FOREIGN PATENT DOCUMENTS

EP 0 362 811 A2 4/1990
EP 0 881 039 A2 12/1998
JP 4-13567 * 1/1992 ..... 451/364

* cited by examiner

*Primary Examiner*—Robert A. Rose
(74) *Attorney, Agent, or Firm*—Laurence A. Greenberg; Werner H. Stemer; Ralph E. Locher

(57) ABSTRACT

A substrate holder is described which has a movable plate elastically mounted inside a main body. With the substrate holder, a polishing operation can be performed in two basic operation modes corresponding to two different vertical end positions of the movable plate. In a first (downward) mode the movable plate stays in mechanical contact with the substrate whereas in a second (upward) mode an air cushion is generated in a chamber between the movable plate and the substrate for pressurizing the substrate onto the polishing pad.

15 Claims, 3 Drawing Sheets

SEMICONDUCTOR SUBSTRATE HOLDER FOR CHEMICAL-MECHANICAL POLISHING CONTAINING A MOVABLE PLATE

BACKGROUND OF THE INVENTION

FIELD OF THE INVENTION

The present invention relates in general to an apparatus for chemical-mechanical polishing (CMP) of semiconductor substrates for polishing and flattening a surface of the semiconductor substrate. More particularly, the invention relates to a semiconductor substrate holder for holding the semiconductor substrate to be polished whereby the substrate is held and pressed against a polishing pad. The holder contains a main body for holding the semiconductor substrate in a predetermined position relative to the main body. The main body has a base plate and a ring-shaped elevation provided thereon. A pressurizing device is provided for pressurizing the semiconductor substrate from inside the ring-shaped elevation towards the underlying polishing pad.

In the processing of integrated semiconductor wafers and integrated circuits many process steps require a subsequent flattening or planarizing of the semiconductor topographical structure. Therefore it is highly important to provide a method and an apparatus for polishing and flattening the surface of the semiconductor substrate to a high flatness degree.

In order to achieve the extent of planarity and thickness homogeneity necessary to produce ultra high-density integrated circuits, chemical-mechanical planarization processes are employed. The chemical-mechanical planarization or polishing (CMP) processes involve in general pressing a semiconductor wafer against a moving polishing surface that contains an abrasive material or is wetted with a chemically reactive, abrasive slurry. The slurries are either basic or acidic and may contain alumina, silica or other abrasive particles. Typically, the polishing surface is a planar pad made of a soft, porous material, such as polyurethane foam or non-woven fabric, and the pad is generally mounted on a planar platen.

A major obstacle for the achievement of a high planarity and a high thickness homogeneity of the surface of a layer to be polished lies in the fact that either the semiconductor substrate below the layer to be polished or the polishing pad may contain thickness or surface variations due to warping or waviness of the wafer or the polishing pad. These variations would normally lead to corresponding local variations in the pressure applied to the semiconductor substrate during polishing and thus to local variations of polishing rates. The construction of a semiconductor substrate holder should therefore provide facilities that would allow to compensate for the inhomogeneities.

A simple configuration of the substrate holder includes a rigid metal plate for pressing the semiconductor substrate against the polishing pad. The standard construction, however, does not allow for any compensation measures for inhomogeneities of substrate thickness or polishing pad thickness.

In U.S. Pat. No. 6,012,964 a semiconductor substrate holder (carrier) is described which is constituted by a housing, a carrier base, a retainer ring, a sheet supporter, a hard sheet and a soft backing sheet. The sheet supporter is formed by a supporter body portion having an air opening communicating with an air outlet/inlet of the carrier base, a flexible diaphragm and an outer ring. A wafer is uniformly pressed by the air pressure in the pressure chamber and fluctuation in the force pressing against the outer peripheral rim of the wafer caused by the wear of the retainer ring is countered by the diaphragm. Also presented in this document are embodiments in which holes are formed in the hard sheet and the soft backing sheet in the area of the wafer center by which it becomes possible to apply an additional back pressure for locally enhancing the polishing rate. These embodiments are, however, applicable only in case of specific known thickness variations of the semiconductor substrate and/or the polishing pad.

In U.S. Pat. No. 5,791,973 and U.S. Pat. No. 6,074,289 a substrate holding apparatus is described which contains a rotary shaft, a substrate holding head in the form of a disc which is provided integrally with the lower edge of the rotary shaft, a sealing member in the form of a ring which is made of an elastic material and fastened to the peripheral portion of the lower face of the substrate holding head, and a guiding member in the form of a ring which is fastened to the back face of the substrate holding head to be located outside the sealing member. A fluid under pressure, preferably air, is introduced into a fluid flow path formed in the rotary shaft from one end thereof and supplied to a space from the other end of the fluid flow path so as to form an air cushion on one side of the substrate and to press the substrate against the polishing pad. Due to the fact that the semiconductor substrate can be deformed in accordance with the surface of the polishing pad and/or the semiconductor substrate the semiconductor substrate can be pressed onto the polishing pad with a locally constant contact pressing force so that also the polishing rate is locally constant over the entire wafer. However, with this configuration it is not possible to introduce a specific local polishing profile by a local variation of the pressing force and hence the polishing rate.

The only way to achieve this would be the incorporation of a plurality of chambers to be supplied with fluids of varying pressure that appears too complicated.

In the introductory portion of U.S. Pat. No. 5,791,973 there is further described with respect to FIG. 16 another configuration of a semiconductor substrate holder wherein an elastic polishing pad is adhered to the top surface of a table. The bottom portion of a substrate holding head is formed with a recessed portion. The substrate is solidly supported by a plate-shaped elastic member that can be elastically deformed in the recessed portion of the substrate. The substrate holding head, elastic member and the substrate define a hermetically sealed space into which a gas under controlled pressure is introduced through a gas supply path. The gas under pressure introduced into the hermetically sealed space presses the substrate solidly supported by the elastic member against the polishing pad, so that the pressure on the upper face of the substrate achieves equal polishing. A disadvantage of the embodiment is the rather complicated mechanism of mounting and dismounting the substrate to the elastic member.

SUMMARY OF THE INVENTION

It is accordingly an object of the invention to provide a semiconductor substrate holder for chemical-mechanical polishing containing a movable plate which overcomes the above-mentioned disadvantages of the prior art devices of this general type, which allows polishing of a semiconductor surface with excellent uniformity over the entire surface area and which also allows the introduction of a specific wanted polishing profile.

With the foregoing and other objects in view there is provided, in accordance with the invention, a semiconductor substrate holder for holding a semiconductor substrate to be polished by chemical-mechanical polishing (CMP). The semiconductor substrate holder contains a main body for holding the semiconductor substrate in a predetermined position relative to the main body. The main body has a base plate and a ring-shaped elevation with an inner wall extending from the base plate. A pressurizing device is provided for pressurizing the semiconductor substrate from inside the ring-shaped elevation towards an underlying polishing pad. The pressurizing device has a movable plate disposed inside the ring-shaped elevation. The movable plate is mounted to the main body such that the movable plate is movable in a direction toward and away from the semiconductor substrate. A support member is disposed on a portion of the inner wall of the ring-shaped elevation. The support member has a support surface for supporting the semiconductor substrate.

With the semiconductor substrate holder according to the present invention the polishing operation can be performed in two basic operation modes corresponding to two different vertical positions of the movable plate.

In a first mode of operation the movable plate is in a lower position where it is in direct mechanical contact with the semiconductor substrate, preferably with a soft backing film in-between. The first mode of operation corresponds therefore to the standard carrier configuration. In the first mode of operation it is possible to vary the polishing profile in a predetermined manner, e.g. by applying a predetermined pressure to predetermined areas of the semiconductor substrate. This can be accomplished by a first fluid supply path formed through the movable plate and outlet openings formed in the lower surface of the movable plate and the backing film which outlet openings are connected with the first fluid supply path. Since the movable plate is in direct mechanical contact with the semiconductor substrate a pressure is exerted only on those substrate portions that are opposite the outlet openings of the movable plate when a fluid is supplied to the outlet openings.

In a second mode of operation the movable plate is in an upper position where it is not in direct mechanical contact with the semiconductor substrate. In this position a chamber is formed between the movable plate and the semiconductor substrate. By the first fluid supply path and the outlet openings formed in the movable plate a fluid, preferably air, can be supplied to the chamber so as to form an air cushion on one side of the substrate and to press the substrate against the polishing pad. This mode of operation allows a homogeneous pressurization of the movable plate and corresponds to the "cushion mode" as known from the above-mentioned prior art documents.

In a preferential embodiment the first and second modes of operation are characterized by predetermined end positions of the movable plate wherein in a first end position corresponding to the first mode of operation a lower surface of the movable plate is in contact with the backside of the semiconductor substrate and in a second end position corresponding to the second mode of operation the lower surface of the movable plate is not in contact with the backside of the semiconductor substrate. The end positions of the movable plate can be defined by an abutment member that can be provided on an inner portion of the ring-shaped elevation. The abutment member may contain two abutment surfaces corresponding to the two end positions and the movable plate may contain an extension acting in combination with the abutment member.

On an inner portion of the ring-shaped elevation a support member is formed, which contains a support surface for supporting the semiconductor substrate. The support surface is flush with the surface of the movable plate in its first end position. In a preferred embodiment, the above-mentioned abutment member is formed integral with the support member.

In a preferential embodiment, the movable plate is actuated by applying a fluid pressure on one side thereof. The movable plate can be mounted on the main body by an impermeable sealing member like a membrane, so that a chamber is formed by the inner walls of the movable plate and the main body and the membrane. A second fluid supply path can be provided for supplying a fluid into the chamber for pressurizing the movable base plate and thereby effecting the movement of the movable base plate. Preferably the sealing member is provided with elastic properties like a spring such that a resting position of the spring corresponds to one of the first or second end positions of the movable plate.

In accordance with an added feature of the invention, the movable plate and the semiconductor substrate define a chamber, and a fluid supply path is fluidically connected to the chamber for supplying a fluid into the chamber. In a preferred embodiment, the fluid supply path runs through the movable plate. The movable plate has a further chamber formed therein and the further chamber is fluidically connected with the fluid supply path. The movable plate has a plurality of openings formed therein fluidically connecting the further chamber to the chamber.

In accordance with an additional feature of the invention, the movable plate has a main surface and the movable plate is movable between a first end position and a second end position. In the first end position, the main surface of the movable plate is in contact with a backside of the semiconductor substrate, and in the second end position, the main surface of the movable plate is not in contact with the backside of the semiconductor substrate.

In accordance with another feature of the invention, an abutment member is disposed on a portion of the inner wall of the ring-shaped elevation. The abutment member has two abutment surfaces corresponding to the first and second end positions. The movable plate has an extension acting in combination with the abutment member.

In accordance with a further feature of the invention, the fluid supply path is a first fluid supply path and a second fluid supply path is provided for supplying the fluid into a space between the movable plate and the base plate for pressurizing the movable plate and thereby effecting a movement of the movable plate.

In accordance with another added feature of the invention, a flexible connecting member connects the movable plate to the base plate. Preferably, the flexible connecting member is an impermeable sealing membrane, and the base plate, the movable plate and the impermeable sealing membrane define another chamber there-between.

In accordance with another further feature of the invention, the flexible connecting member is a spring member, and the spring member is connected to the movable plate and to the base plate such that in one of the first and second end positions of the movable plate the spring member is in a resting position.

In accordance with another additional feature of the invention, the support member is a part of the abutment member. Alternatively, the support member is directly connected with the abutment member or the support member is formed integral with the abutment member.

In accordance with a concomitant feature of the invention, at least one third fluid supply path is provided for supplying the fluid into an outer area of the chamber.

Other features which are considered as characteristic for the invention are set forth in the appended claims.

Although the invention is illustrated and described herein as embodied in a semiconductor substrate holder for chemical-mechanical polishing containing a movable plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
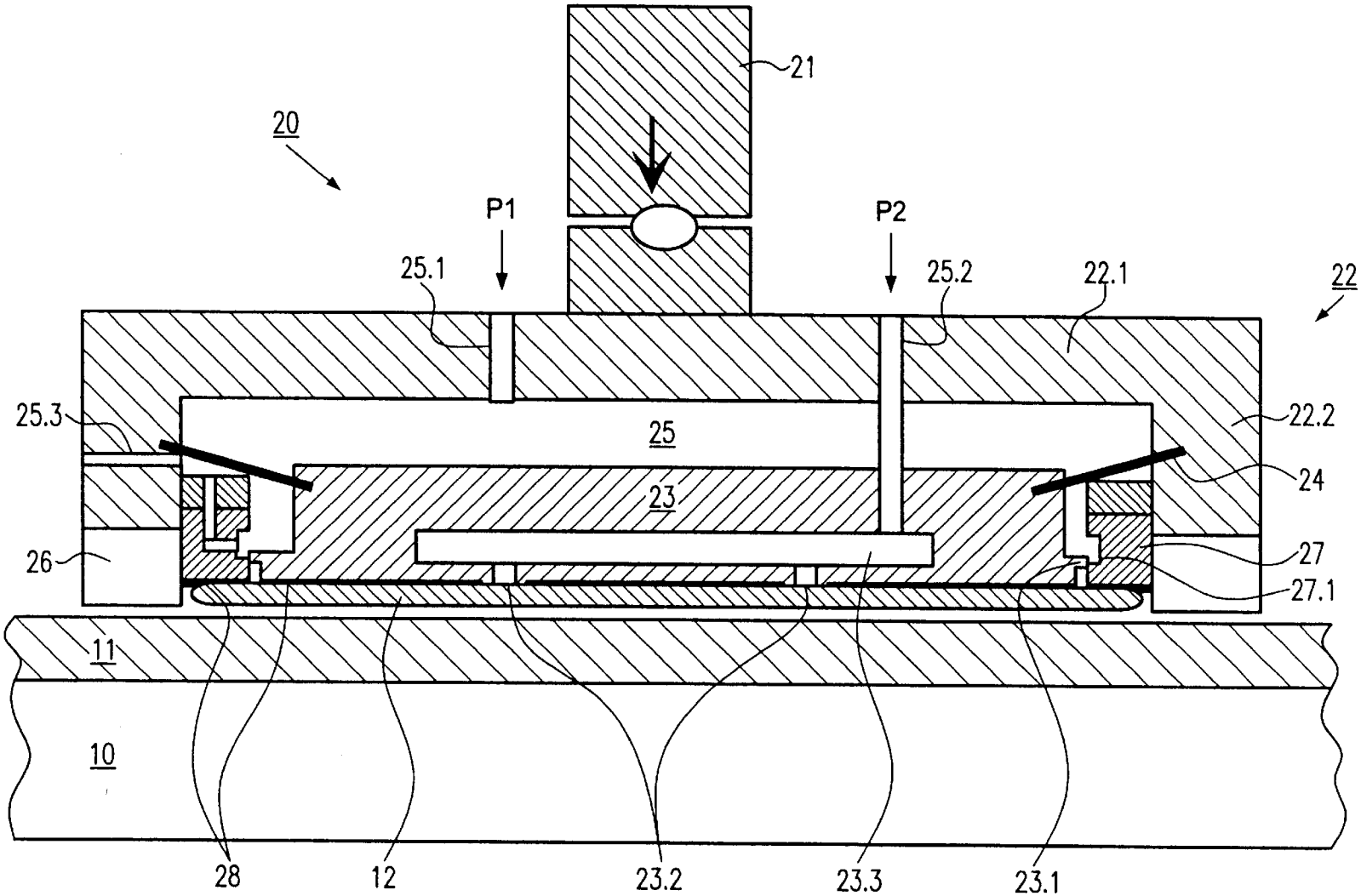
FIG. 1 is a diagrammatic, cross-sectional view of a semiconductor substrate holder according to a first embodiment together with a polishing pad in a state according to a first mode of operation according to the invention.

Referring now to the figures of the drawing in detail and first, particularly, to FIG. 1 thereof, there is shown a cross-sectional view of a semiconductor substrate holder to be polished according to a first embodiment of the present invention. A rotatable table 10 is shown and has a flat surface that is made of a rigid material and an elastic polishing pad 11 adheres to a top surface of the table 10.

Above the table 10 is provided a substrate holder 20 for holding a semiconductor substrate 12. The substrate holder 20 contains a rotary shaft 21 rotated by a non-illustrated rotary drive and a main body 22 in the form of a disc provided on a lower edge of the rotary shaft 21. The main body 22 is formed of a base plate 22.1 and a ring-shaped elevation 22.2 thereon. A downward vertical force can be exerted on the rotary shaft 21 and transmitted to the main body 22 by an apparatus not shown in FIG. 1.

Inside the ring-shaped elevation 22.2 a disc-shaped movable plate 23 is affixed to the main body 22, i.e. to a portion of the main body 22 corresponding to the ring-shaped elevation 22.2 thereof, by an elastic sealing membrane 24. Between the movable plate 23 and the main body 22 a chamber 25 is formed wherein the walls of the chamber 25 are constituted by portions of inner walls of the movable plate 23 and the main body 22 and by the elastic membrane 24. The chamber 25 can be supplied with a fluid such as air via a fluid supply path 25.1 formed in a portion of the wall of the main body 22 in order to generate a pressure P1 inside the chamber 25 which is higher than atmospheric pressure to thereby pressurize the movable plate 23 in a downward direction. It is also possible to evacuate the chamber 25 via the fluid supply path in order to generate a pressure inside the chamber 25 that is lower than atmospheric pressure to thereby suck the movable plate 23 in an upward direction.

Alternatively it would be also possible to omit the chamber 25 and the fluid supply path 25.1 and to exert a force on the movable plate 23 merely by a mechanical method.

On an outer surface of the main body 22, i.e. on the ring-shaped elevation 22.2 a retaining ring 26 is provided which can be formed integral with the main body 22. On a portion of the inner wall of the ring-shaped elevation 22.2 a ring-shaped support member 27 is provided which contains a corresponding ring-shaped support surface for receiving a back surface of the semiconductor substrate 12 thereon. A radial width of the ring-shaped support member 27 and thus of the support surface is preferably in the range of 2–10 mm. The support member 27 is provided such that a height difference between the support surface and the surface of the retaining ring 26 is less than the height of the substrate 12 by an infinitesimal amount.

The lower surface of the movable plate 23 and the support surface of the support member 27 can be covered with a soft backing film 28.

The support member 27 can also be formed integral with the main body 22.

The support member 27 has also the function of an abutment member 27 for defining the end positions of the movable plate 23. For this purpose the abutment member 27 contains a recess 27.1 on an inner wall thereof, wherein an extension 23.1 of the movable plate 23 engages and is movable therein between upper and lower end faces of the recess 27.1. Alternatively it would also be possible to provide an abutment member that is not formed integral with the support member 27.

The elastic sealing member 24 is an elastic spring-like membrane 24 that can be mounted between the main body 22 and the movable plate 23 such that it is in a resting position when the movable plate 23 is in its upper (second) end position and that it is in an elongated position when the movable plate 23 is in its lower (first) end position. In order to bring the movable plate 23 to the lower position air is supplied to the chamber 25 and the movable plate 23 is pressurized in a downward direction against the force of the elastic spring-like membrane 24.

Figure 2:
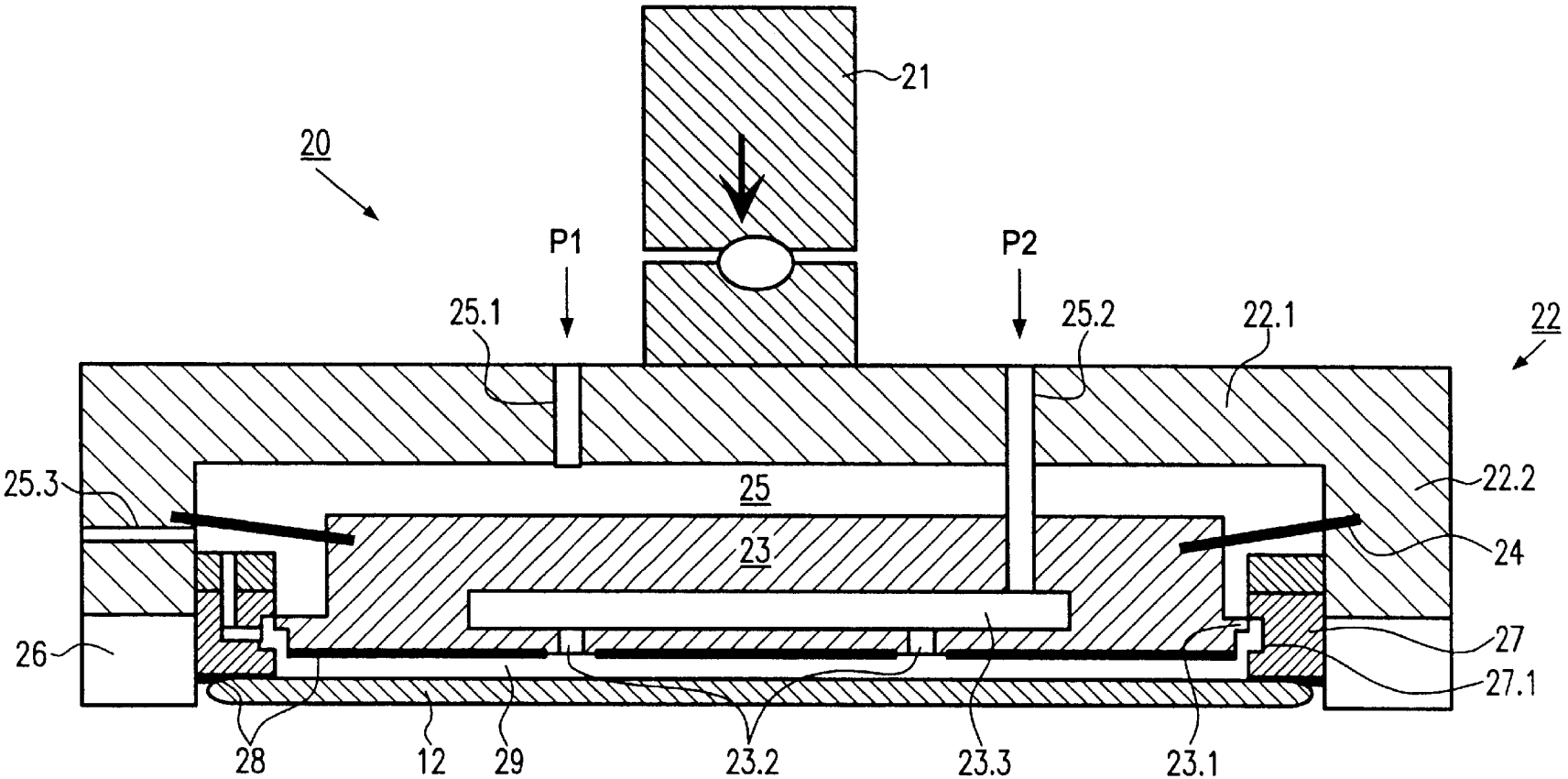
FIG. 2 is a diagrammatic, cross-sectional view of the semiconductor substrate holder according to the first embodiment in a state according to a second mode of operation.

In FIG. 1 the semiconductor substrate holder 20 is shown in a downward (first) position wherein in FIG. 2 the semiconductor substrate holder 20 is shown in an upward (second) position.

The first mode of operation as depicted in FIG. 1 corresponds to a standard carrier configuration as it is known from the prior art. In this operation mode it is possible to generate a predetermined polishing profile over the wafer by applying a pressure on pre-selected portions of the semiconductor substrate 12. For this purpose a fluid supply path 25.2 is provided which includes a tube extending from an opening in the wall of the main body 22 into an inner chamber 23.3 of the movable plate 23. From the inner chamber 23.3 connection paths are formed to connect the inner chamber 23.3 with openings 23.2 formed in a rear surface of the movable plate 23 and the backing film 28. In the present case two openings 23.2 are formed symmetrically with respect to the center of the movable plate 23.

By applying a pressure P2 to the fluid supply path 25.2 and thus to those portions of the semiconductor substrate 12 opposite to the openings 23.2 there can be adjusted a radial gradient of the pressing force and of the polishing rate. Due to the pressure P2 the substrate 12 is deformed underneath the openings 23.2. The pressure P2 which is applied to the fluid supply path 25.2 can be chosen such that it is higher than atmospheric pressure which is exerted on the backside of the semiconductor substrate 12 due to the vertical force applied to the rotary shaft 21 in order to generate a higher polishing rate in the area of the openings 23.2. Alternatively a pressure P2 can be applied, e.g. by evacuating the chamber 23.3 through the fluid supply path 25.2, which pressure P2 is lower than atmospheric pressure of the movable plate 23 on the back surface of the substrate in order to generate a lower polishing rate in the area of the openings 23.2.

In the second operation mode of the movable plate 23 which is shown in FIG. 2 a homogeneous pressurization over the substrate area and hence a homogeneous polishing profile can be generated. In this mode the fluid supply path 25.2 serves for establishing an air cushion in a chamber 29 surrounded by the substrate 12, the movable plate 23 and the supporting member 27. In this case the openings 23.2 serve as distribution openings for distributing the air that is supplied via the fluid supply path 25.2 within the chamber 29.

The pressure P2 can be chosen such high that a clearance will be formed between the substrate 12 and the support member 27 so that a part of the pressurized air can leak out of the chamber 29 through the clearance. Alternatively a third fluid supply path 25.3 can be provided which extends from a through hole in the wall of the main body 22 and a through hole in the support member 27 into the chamber 29. In a part of the third fluid supply path 25.3 outside the main body 22 a non-illustrated adjustable valve can be implemented by which a controlled leak out of air out of the chamber 29 can be achieved.

In addition the third fluid supply path 25.3 can be used to generate a pressure gradient in the air cushion in the chamber 29 and a corresponding inhomogeneity of the polishing rate either by supplying air to the chamber 29 or by sucking out air therefrom.

Figure 3:
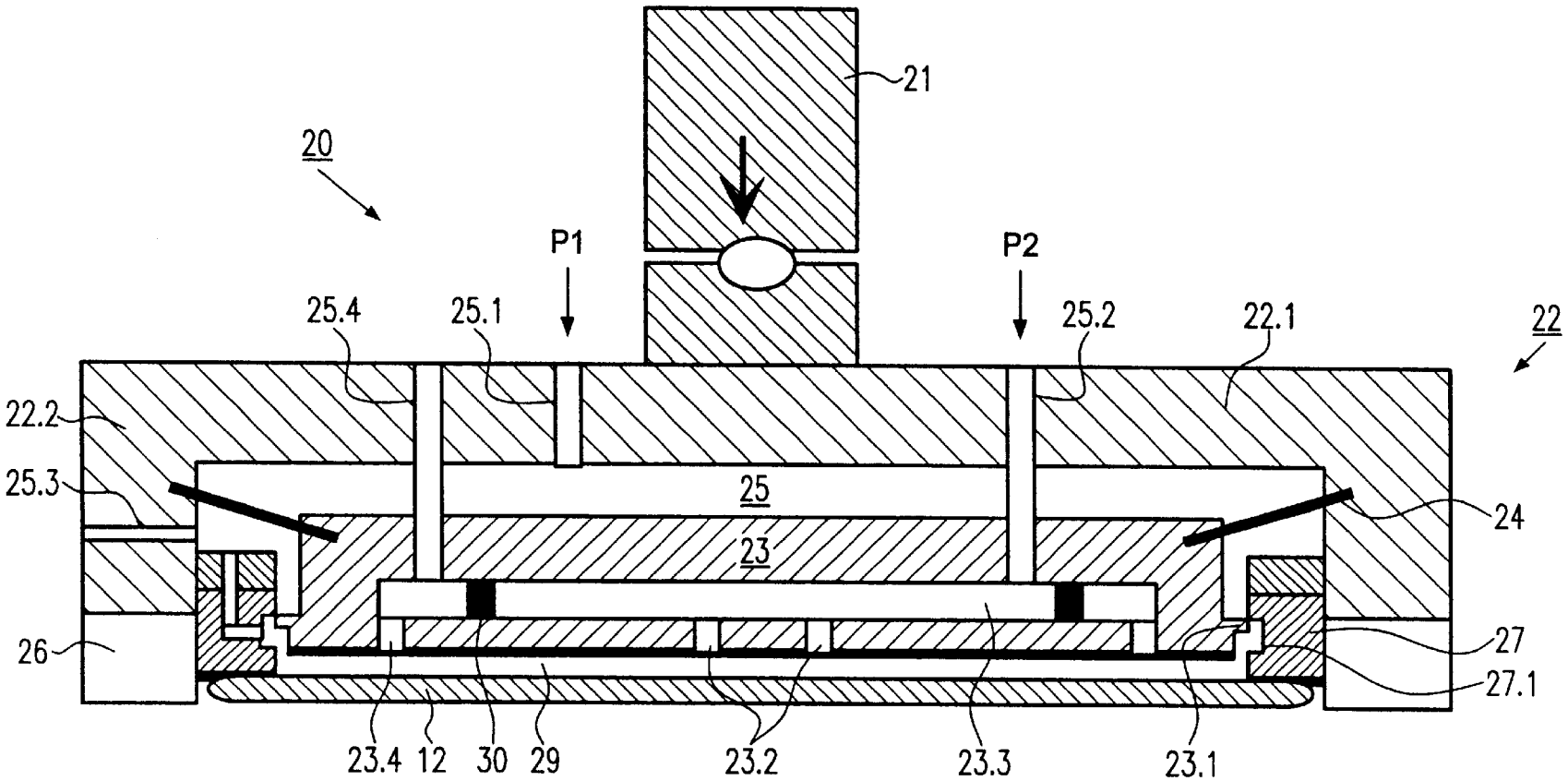
FIG. 3 is a diagrammatic, cross-sectional view of a second embodiment of the semiconductor substrate holder in a state according to a second mode of operation.

FIG. 3 shows an alternate embodiment of the semiconductor substrate holder 20 in which a fourth fluid supply path 25.4 is provided which should fulfill the same function as was previously described with respect to the third fluid supply path 25.3. The fourth fluid supply path 25.4 includes a tube extending from an opening in the wall of the main body 22 into an outer area of the inner chamber 23.3 of the movable plate 23. The outer area is separated from the inner area by a concentric sealing ring 30. From the outer area an opening 23.4. extends into the chamber 29.

The fourth fluid supply path 25.4 or the fluid supply path 25.3 could be used also for supplying a cleaning agent like water to the chamber 29 in order to clean the inner surfaces of the substrate holder 20 from slurry waste.

The fourth fluid supply path 25.4 may be employed instead or in addition to the third fluid supply path 25.3. By supplying a sufficient pressure through the third and/or the fourth fluid supply paths and at the same time adjusting a reduced pressure P2 in the fluid supply path 25.2 a deformation of the substrate occurs such that the polishing rate at a substrate edge is high and the polishing rate in the center of the substrate is low.

In a polishing process a time division between the two operation modes will be employed in that in a part of the polishing time the first operation mode will be applied and in another part of the polishing time the second operation mode will be carried out.

In a preferred embodiment the touch down and lift off of the wafer onto the polishing pad is performed with the movable plate in the lower position in order to prevent high polishing rates at the outer wafer edge during these phases of the polishing process.

In another preferred embodiment the retaining ring can be moved relative to the support surface of support member 27, in order to influence the polishing rate at the wafer edge in both operation modes.

We claim:

1. A semiconductor substrate holder for holding a semiconductor substrate to be polished by chemical-mechanical polishing (CMP), the semiconductor substrate holder comprising:

a main body for holding the semiconductor substrate in a predetermined position relative to said main body, said main body having a base plate and a ring-shaped elevation with an inner wall extending from said base plate;

a pressurizing device for pressurizing the semiconductor substrate from inside said ring-shaped elevation towards an underlying polishing pad, said pressurizing device having a movable plate disposed inside said ring-shaped elevation, said movable plate mounted to said main body such that said movable plate being movable in a direction toward and away from the semiconductor substrate; and a support member disposed on a portion of said inner wall of said ring-shaped elevation, said support member having a support surface for supporting the semiconductor substrate.

2. The semiconductor substrate holder according to claim 1, wherein said movable plate and the semiconductor substrate define a chamber; and further comprising a fluid supply path fluidically connected to said chamber for supplying a fluid into said chamber.

3. The semiconductor substrate holder according to claim 2, wherein said fluid supply path runs through said movable plate.

4. The semiconductor substrate holder according to claim 3, wherein:

said movable plate has a further chamber formed therein and said further chamber is fluidically connected with said fluid supply path; and said movable plate has a plurality of openings formed therein fluidically connecting said further chamber to said chamber.

5. The semiconductor substrate holder according to claim 3, wherein:

said movable plate has a main surface;

said movable plate is movable between a first end position and a second end position, in said first end position, said main surface of said movable plate is in contact with a backside of the semiconductor substrate; and in said second end position, said main surface of said movable plate is not in contact with the backside of the semiconductor substrate.

6. The semiconductor substrate holder according to claim 5, further comprising an abutment member disposed on a portion of said inner wall of said ring-shaped elevation, said abutment member having two abutment surfaces corresponding to said first and second end positions, said movable plate having an extension acting in combination with said abutment member.

7. The semiconductor substrate holder according to claim 2, wherein said fluid supply path is a first fluid supply path; and further comprising a second fluid supply path for supplying the fluid into a space between said movable plate and said base plate for pressurizing said movable plate and thereby effecting a movement of said movable plate.

8. The semiconductor substrate holder according to claim 6, further comprising a flexible connecting member connecting said movable plate to said base plate.

9. The semiconductor substrate holder according to claim 8, wherein:

said flexible connecting member is an impermeable sealing membrane; and said base plate, said movable plate and said impermeable sealing membrane define another chamber therebetween.

10. The semiconductor substrate holder according to claim 8, wherein:

said flexible connecting member is a spring member; and said spring member is connected to said movable plate and to said base plate such that in one of said first and second end positions of said movable plate said spring member is in a resting position.

11. The semiconductor substrate holder according to claim 10, wherein said support member is a part of said abutment member.

12. The semiconductor substrate holder according to claim 10, wherein said support member is directly connected with said abutment member.

13. The semiconductor substrate holder according to claim 10, wherein said support member is formed integral with said abutment member.

14. The semiconductor substrate holder according to claim 7, further comprising at least one third fluid supply path for supplying the fluid into an outer area of said chamber.

15. An apparatus for polishing a semiconductor substrate by chemical-mechanical polishing, the apparatus comprising:

a semiconductor substrate holder containing:

a main body for holding the semiconductor substrate in a predetermined position relative to said main body, said main body having a base plate and a ring-shaped elevation with an inner wall extending from said base plate;

a pressurizing device for pressurizing the semiconductor substrate from inside said ring-shaped elevation towards an underlying polishing pad, said pressurizing device having a movable plate disposed inside said ring-shaped elevation, said movable plate mounted to said main body such that said movable plate being movable in a direction toward and away from the semiconductor substrate; and a support member disposed on a portion of said inner wall of said ring-shaped elevation, said support member having a support surface for supporting the semiconductor substrate.

* * * * *